US006295682B1

(12) United States Patent
Klucznik

(10) Patent No.: US 6,295,682 B1
(45) Date of Patent: Oct. 2, 2001

(54) RIDEABLE CLEANING APPLIANCE

(76) Inventor: John H. Klucznik, 415 Wexford Way, Telford, PA (US) 18969

( * ) Notice: Subject to any disclaimer, the term of this patent is extended or adjusted under 35 U.S.C. 154(b) by 0 days.

(21) Appl. No.: 09/405,476

(22) Filed: Sep. 24, 1999

(51) Int. Cl.[7] ..... A47L 11/03; A47L 11/16

(52) U.S. Cl. ..... 15/50.1; 15/49.1; 15/98; 15/320; 15/340.3

(58) Field of Search ..... 15/49.1, 50.1, 15/98, 320, 340.3, 340.4, 82, 87, 50.3, 52.1

(56) References Cited

U.S. PATENT DOCUMENTS

| | | | | |
|---|---|---|---|---|
| 1,191,489 | * | 7/1916 | Whinery | 15/98 |
| 1,275,322 | * | 8/1918 | Simko | 15/340.3 |
| 2,330,025 | * | 9/1943 | Bentley et al. | 15/82 |
| 3,105,991 | * | 10/1963 | Oberg | 15/320 |
| 3,192,547 | * | 7/1965 | Nahrstedt et al. | 15/321 X |
| 3,193,862 | * | 7/1965 | Lyon | 15/87 |
| 3,197,798 | * | 8/1965 | Brown et al. | 15/320 |
| 3,204,280 | | 9/1965 | Campbell | 15/314 |
| 3,281,879 | * | 11/1966 | Murphy | 15/87 X |
| 3,299,460 | * | 1/1967 | Burgoon | 15/49.1 |
| 3,345,671 | * | 10/1967 | Wilson et al. | 15/320 |
| 3,376,597 | * | 4/1968 | Boyd | 15/320 |
| 3,402,420 | | 9/1968 | Schaeffer | 15/320 |
| 3,604,051 | * | 9/1971 | Wendel et al. | 15/340.4 |
| 3,701,177 | * | 10/1972 | Meyer et al. | 15/50.1 |
| 3,866,541 | * | 2/1975 | O'Connor et al. | 15/50.1 |
| 3,942,218 | * | 3/1976 | Krier et al. | 15/50.1 X |
| 4,009,500 | * | 3/1977 | Ashton | 15/50.1 |
| 4,654,918 | * | 4/1987 | Cooper | 15/98 |
| 4,759,094 | | 7/1988 | Palmer et al. | 15/320 |
| 5,465,456 | | 11/1995 | Fellhauer et al. | 15/320 |
| 5,607,178 | | 3/1997 | Legatt et al. | 280/716 |
| 5,687,443 | * | 11/1997 | Moore | 15/98 |
| 5,873,138 | | 2/1999 | Geyer et al. | 15/50.1 |

FOREIGN PATENT DOCUMENTS

| | | | | |
|---|---|---|---|---|
| 518850 | * | 11/1955 | (CA) | 15/82 |
| 1286985 | * | 8/1972 | (GB) | 15/321 |
| 787549 | * | 12/1980 | (SU) | 15/87 |

* cited by examiner

*Primary Examiner*—Mark Spisich
(74) *Attorney, Agent, or Firm*—Zachary T. Wobensmith, III

(57) ABSTRACT

A rideable carpet cleaning system in which the assembly that is ridden is releasably attached to a power bonnet assembly to facilitate storage cleaning and repair. The system is battery operated and includes a forward mounted steering assembly. The bonnet assembly is mounted partially forward of the steering wheel and a link-pin feature allows the operator to lower or raise the assembly for engagement or storage purposes, as desired, with minimum effort.

10 Claims, 6 Drawing Sheets

FIG. 3
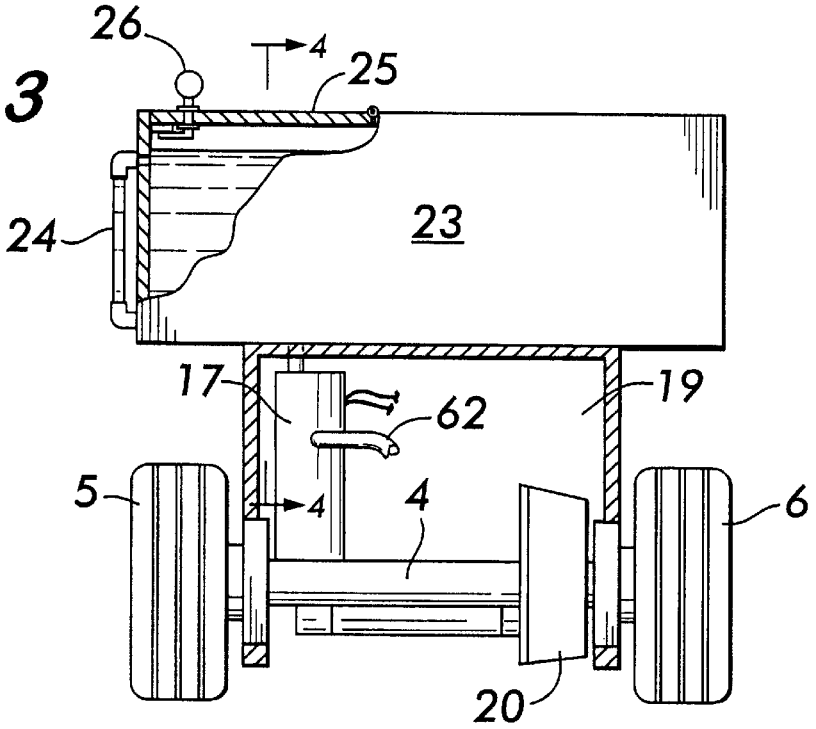
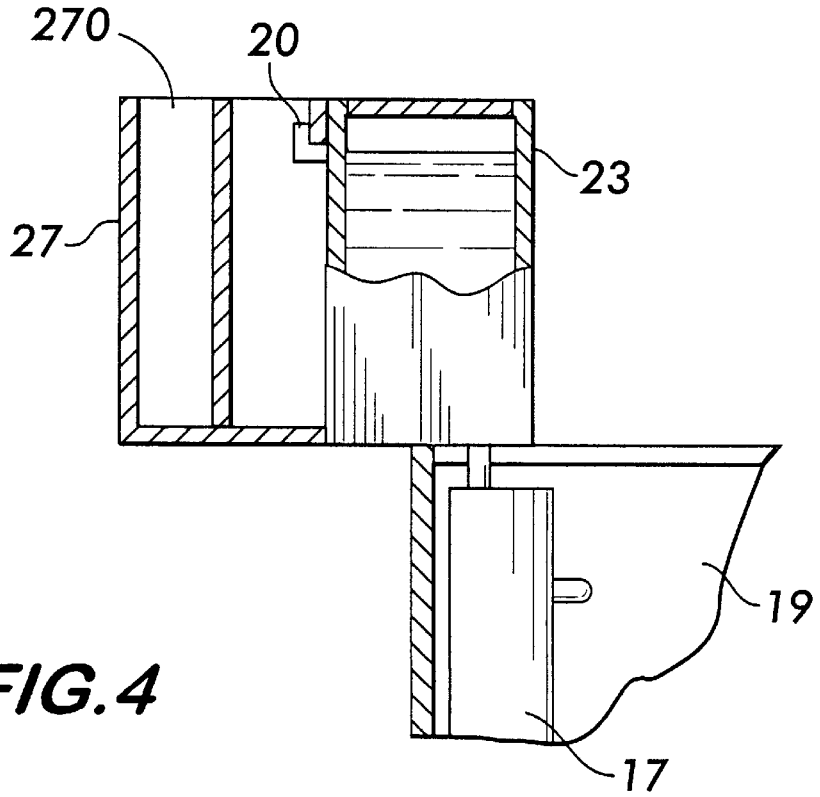
FIG. 4

RIDEABLE CLEANING APPLIANCE

BACKGROUND OF INVENTION

Rideable assemblies which clean, scrub and wax floors are known in the art; however, none of these systems provide a cleaning assembly in which a bonnet cleaner is detachably joined to a rideable appliance.

Moreover, none of the known cleaning systems show the cleaner in a position which is forward of the operator; where it can be viewed during the cleaning operation.

In U.S. Pat. No. 3,204,280, Campbell describes a rideable machine for cleaning and waxing floors. This machine includes four brushes; one for sweeping, two for cleaning and waxing and a fourth brush for polishing; however, none of these are bonnet type cleaners nor can they be easily attached or detached or viewed by the operator during the cleaning operation.

In U.S. Pat. No. 5,607,178, Legatt et al. describes a rideable floor scrubber in which the novelty resides in the use of elastomeric isolator mounts for damping vibrations; the object of which is to extend the life of the cleaning machine and its batteries. However, Legatt et al. fails to show any easily detachable means for securing the scrubbing brush to the carriage which is being ridden; moreover, the brush is located behind a drive wheel and as a result, it is invisible to the operator during the cleaning process.

Schaeffer, in U.S. Pat. No. 3,402,420, describes a carpet cleaning device in which the cleaning brush is located at the front of the assembly so that it can be viewed by the operator during the cleaning process; however, this is a hand held, manually operated cleaning system.

The difficulty with the Schaeffer system is that its disc-like buffer creates a rotational energy with respect to the horizontally disposed cleaning surface and this impels the device in sidewise directions. As a result, this device requires a sustained effort on the part of the operator in order to move it in a straight-line direction.

Accordingly, there is a need for a bonnet-type cleaning system which can be easily manipulated and impelled forward in a straight line without effort by the operator.

There is also a need for a bonnet cleaner which can be ridden and whose cleaning assembly can be releasably attached and detached with ease.

SUMMARY OF THE INVENTION

This invention relates to a rideable appliance which is equipped with a cleaning assembly that may be easily detached for cleaning, storage and/or repair purposes. This appliance is battery-powered and its carriage is equipped with a seat and steering means.

This apparatus provides a straight-line means for cleaning against a sidewall so that the arcs and misses associated with manually operated bonnet cleaners can be avoided.

The cleaning assembly consists of a bonnet-type cleaner or power brush which is releasably mounted forward of the steering mechanism and includes means for tilting the brush assembly forward for engagement purposes and for tilting upwards when it is to be disengaged or placed in neutral.

The carriage housing is also equipped with accoutrements which may be needed by the operator while conducting a typical cleaning operation. These include an on-board dispenser for supplying cleaning solution, a hand held power sprayer and an optional wet/vac system which is mounted at the rear of the carriage.

Other embodiments which constitute points of novelty include, for example, a linking pin assembly means for releasably attaching and detaching the carriage and the bonnet cleaner to one another.

Another embodiment of this invention is a spray means by which a user may dispense cleaning solution, by hand, directly and precisely onto the area which is to be treated so that splashing onto adjacent walls or baseboards can be avoided.

Also included is a line of sight tank which provides the operator with a sight view indicator for monitoring fluid levels of cleaning solution while conducting a cleaning operation. Once the operation is concluded, a drain means is used to discharge from the tank whatever remains of the cleaning solution.

A further embodiment provides for converting the assembly of this invention from a carpet cleaner to a scrubbing assembly which can be used to strip wax from floors. In this embodiment, the carpet-cleaning bonnet is replaced by a brush which has wax-stripping capabilities and which will otherwise prepare the floor for further treatment.

Also included in this invention is means for adding to the carriage a squeegee and/or vacuum system means for clean-up purposes when a floor stripping operation is in progress.

Other aspects of this invention will be apparent from the following description and appended claims and, also, the drawings where the numbered characters correspond to the like-numbered characters in the specification.

BRIEF DESCRIPTION OF THE DRAWINGS

FIG. 3 is a sectional view taken along line 3—3 of FIG. 1.

FIG. 4 is a sectional view taken along line 4—4 of FIG. 3.

DESCRIPTION OF THE PREFERRED EMBODIMENT

Figure 1:
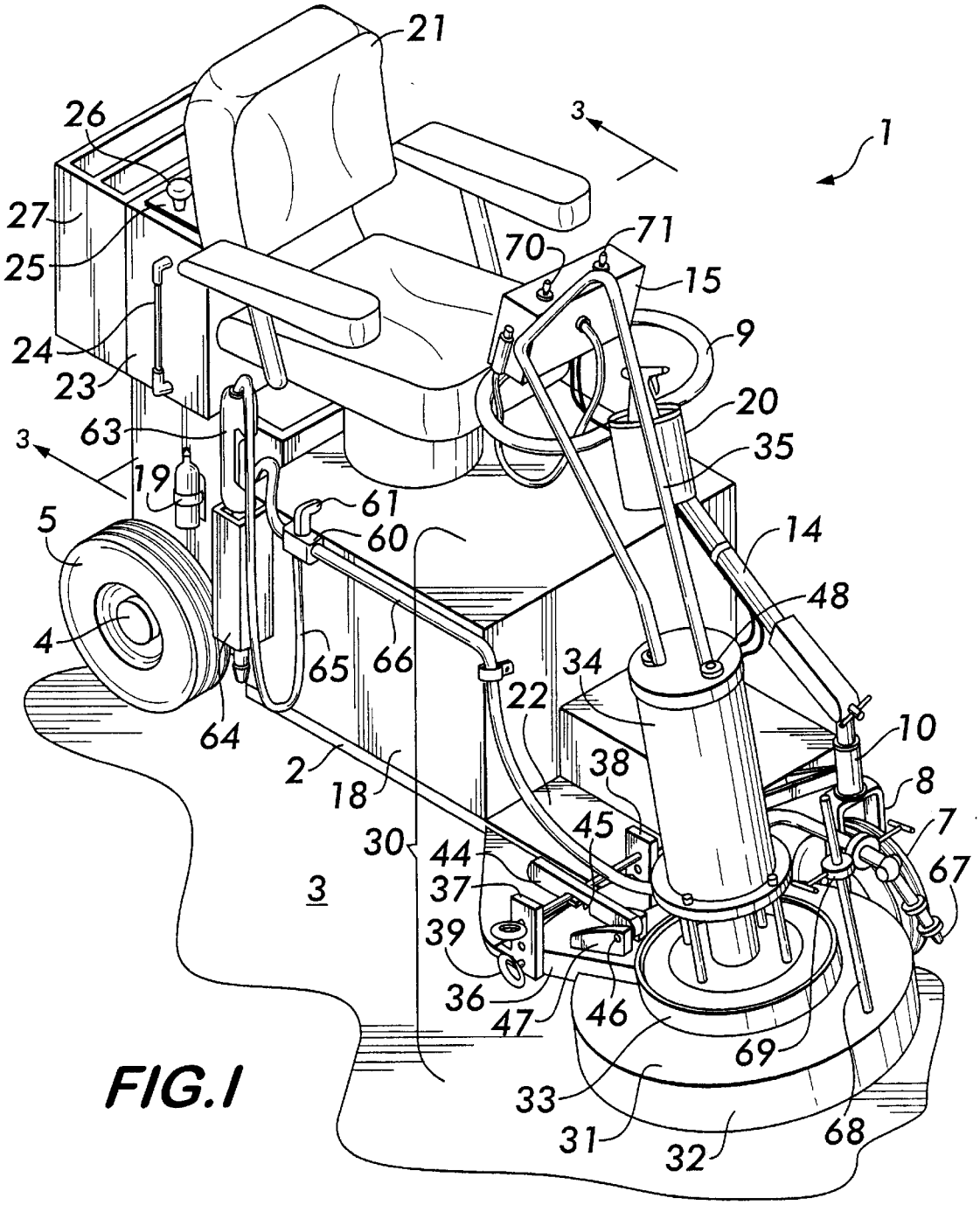
FIG. 1 is a front perspective view of the cleaning system of the present invention taken from the right side, and shown with a single power brush.
Figure 2:
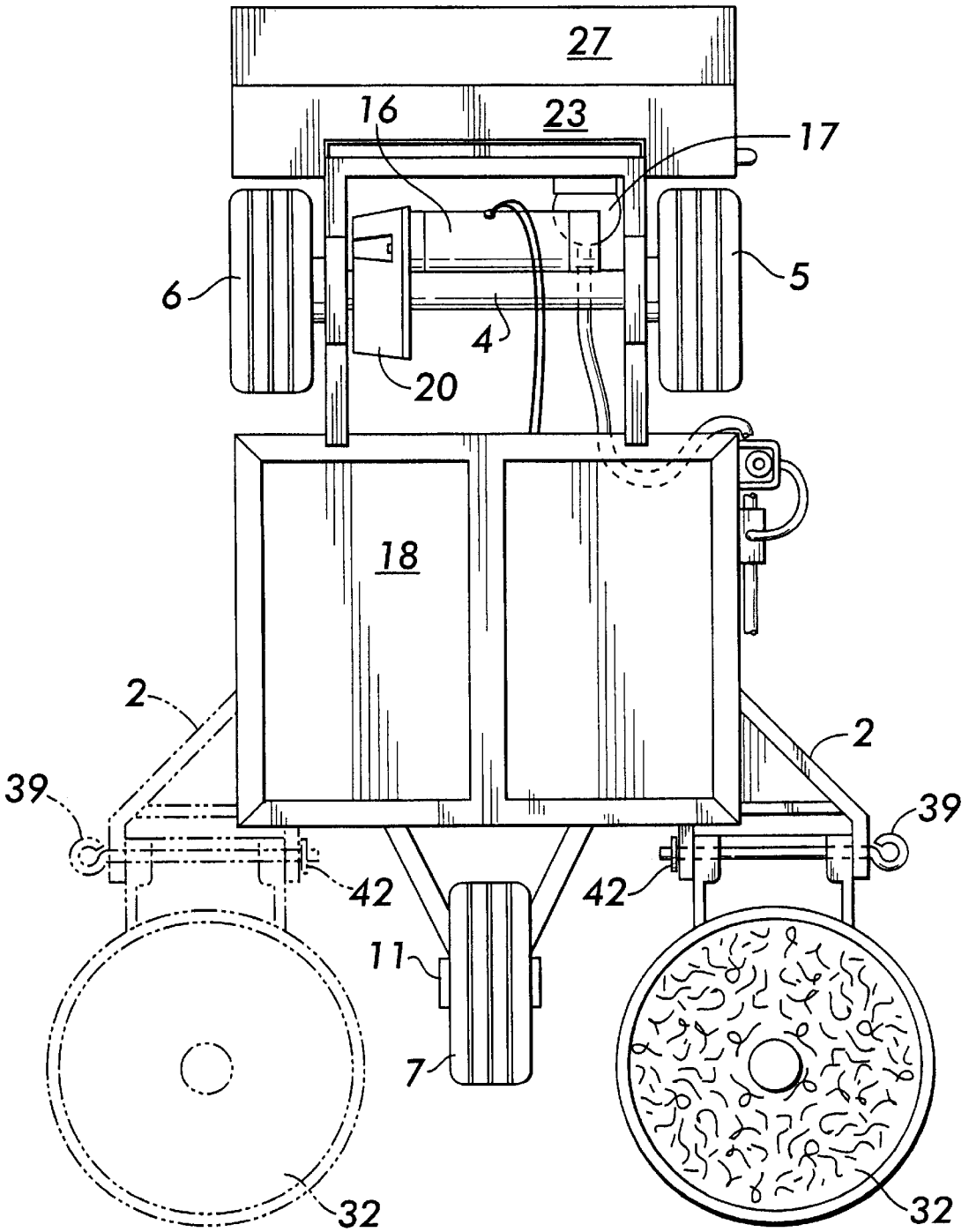
FIG. 2 is a bottom plan view of the system shown in FIG. 1 with a second or alternately mounted power brush shown in phantom.

The cleaning system of this invention is shown generally as 1 in FIG. 1 and includes a carriage 2 supported by a rear axle 4 equipped with a pair of powered wheels 5 and 6 (FIGS. 2 and 3). Power is supplied by batteries housed within the battery compartment identified as 18 in FIGS. 1 and 2. Mounted to the carriage 2 is a chair 21 and footrest, one of which is shown in FIG. 1 as 22, the opposite side footrest not being shown.

The front wheel 7 of carriage 2 (FIG. 2) and U-shaped bracket 8 are pivotable in front bracket 10 and, in combination with handle bar 9 and steering rod 14, they provide the user with a convenient steering means. The U-shaped bracket 8 also provides a mount for the front axle 11 (FIG. 2) and it is joined thereto by means which are known in the art.

A control unit 15 adjacent to the handle bar 9 controls the bi-directional motor 16 and the pump 17 (FIG. 2) and allows the user to control the operation of the cleaning system. Included in the control unit is a speed control dial 90 and a battery level indicator 91. A power brush assembly, shown generally as 30 in FIGS. 1 and 6, includes a motor housing 34 which extends upwardly in a direction perpendicular to the buffer housing 31. Buffer housing 31 supports the cleaning tool that is to be employed in the cleaning operation, whether it be a brush or the buffer identified generally as 32 in FIG. 1.

A collar 33 joined to buffer housing 31, supports a drive motor (not shown) which is housed within motor housing 34 equipped with a tiltable handle 35. This handle is secured to the top of motor housing 34 by bolts 48 and, the bottom end of the motor housing is secured to collar 33 of the brush assembly by the series of bolts shown as 43 in FIG. 7.

Figure 8:
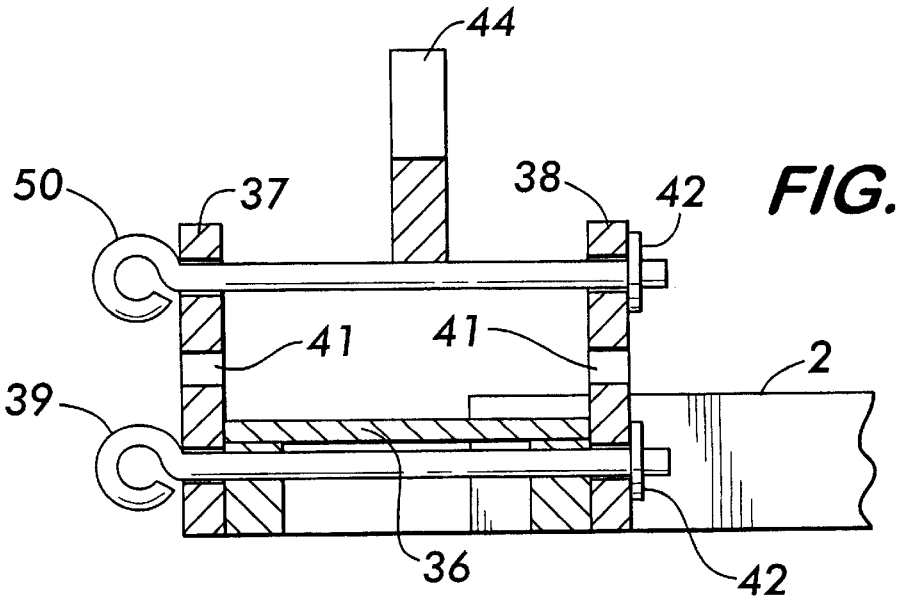
FIG. 8 is a sectional view taken along line 8—8 of FIG. 6.

The power brush assembly 30 is joined to the carriage 2 by a bracket 36 and a pair of vertical braces 37 and 38 (FIG. 8) and these vertical braces are permanently mounted to the carriage 2. The bracket 36 serves as a fulcrum for the collar 33 and it is joined thereto by a first linch-pin 39 which is inserted through a mounting hole of the vertical brace 37, a corresponding hole in the bracket 36 and a mounting hole (not shown) in the vertical bracket 38 (FIG. 8). The linch-pin 39 is secured by cotter pins 42. Alternate height-mounting holes 41 provide means for raising and lowering the power brush assembly.

Figure 5:
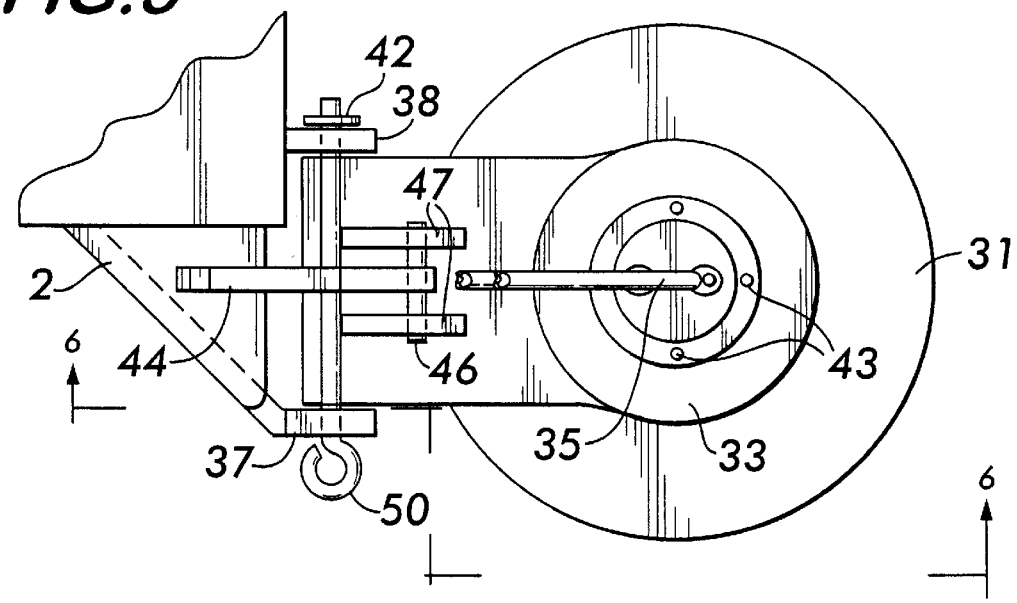
FIG. 5 is a top view of the power brush assembly.
Figure 6:
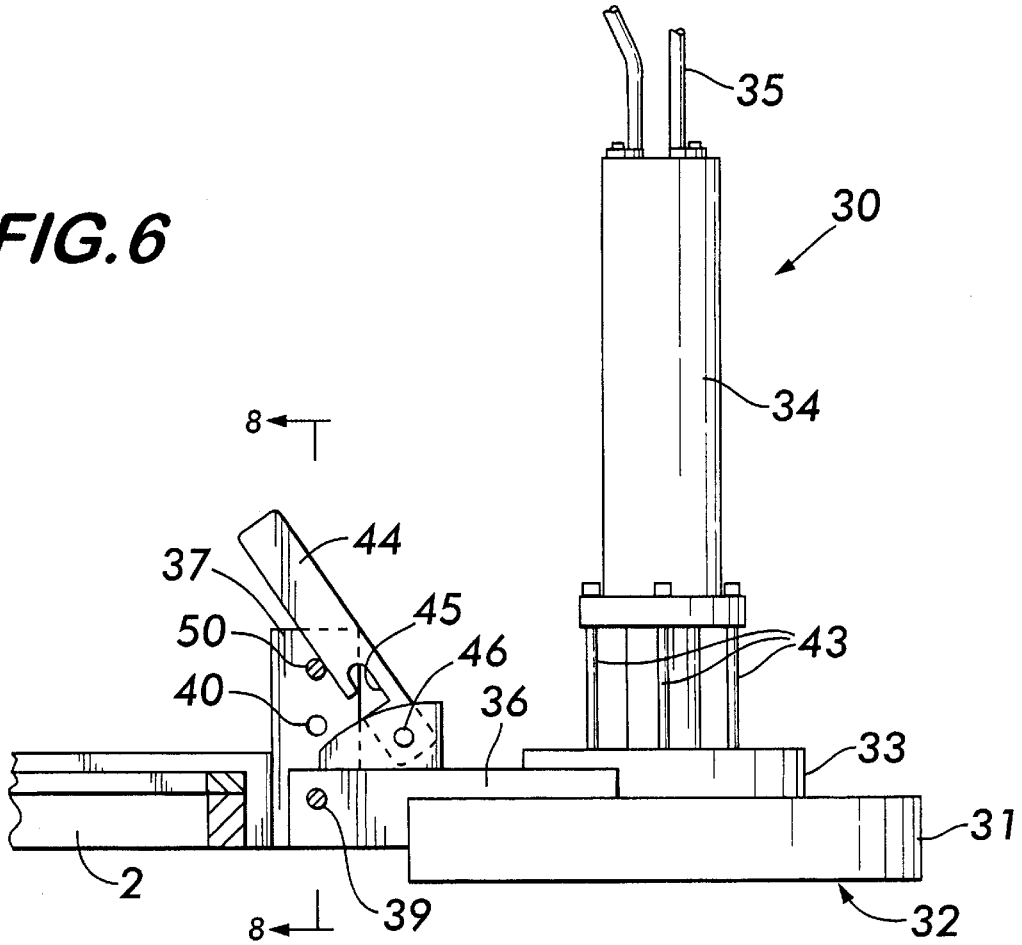
FIG. 6 is a sectional view taken along line 6—6 of FIG. 5 showing a single power brush in an engaged mode.
Figure 7:
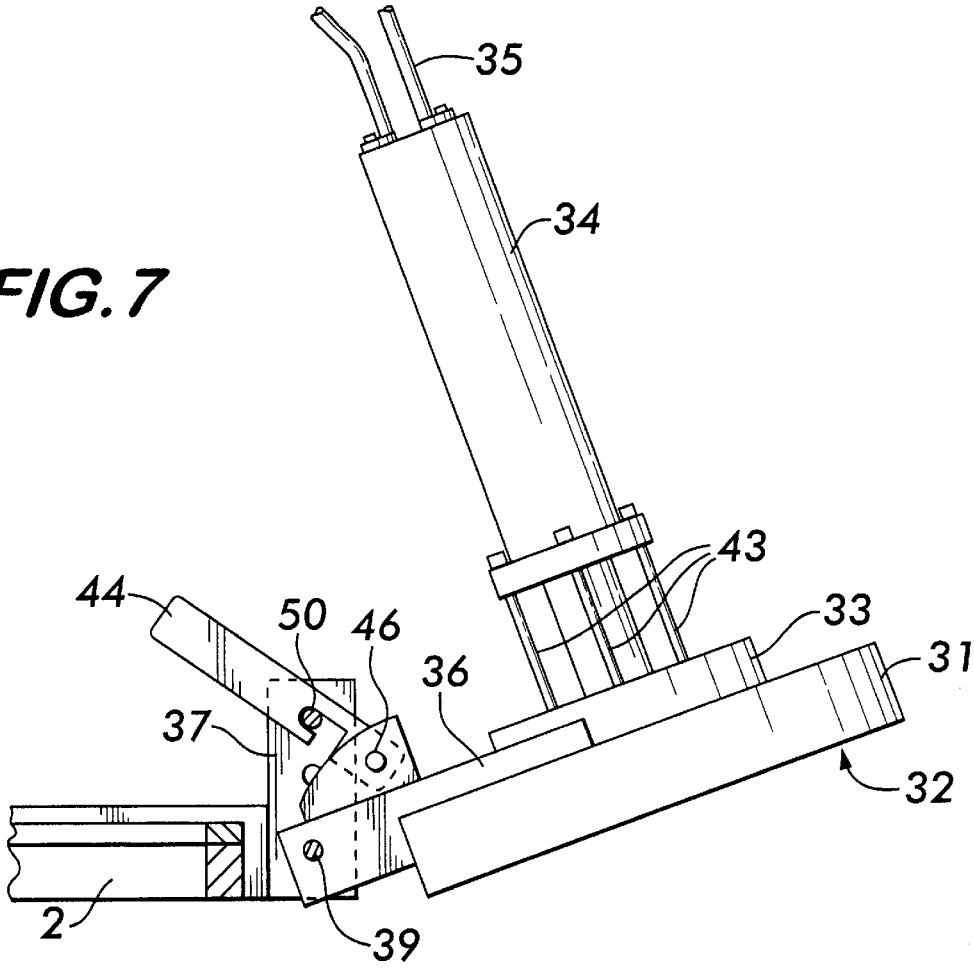
FIG. 7 is a sectional view showing the power brush of FIG. 6 in a raised or disengaged mode.

For optimum cleaning efficiency, it is desirable to have the capability of raising and lowering the power brush assembly 30 with a minimum of hand labor and this is achieved by virtue of the control arm shown as 44 in FIGS. 1, 5, 6, 7 and 8. FIGS. 6 and 7 are particularly illustrative because they show the control arm 44 in position where the power brush assembly 30 is lowered for engagement (FIG. 6) and tilted upwards or raised (FIG. 7) when not in use. For operation of the control arm 44, the bracket 36 (FIGS. 6 and 7) is equipped with a pair of supports 47 and a support axle 46 secured therebetween (FIG. 5). The control arm 44 pivots about the support axle 46 and it is releasably secured to a second linch-pin 50 via slot 45 (FIG. 6).

In practice when the power brush assembly 30 is to be engaged for washing or polishing purposes, the operator may use his or her right foot to flip the control arm 44 upwardly and thereby release the control arm from the linch-pin 50 so that the power brush assembly 30 can be made to rest on the work surface 3. When the power brush assembly is to be raised from the work surface and placed in neutral, the user simply tilts the tiltable handle 35 downward so as to secure the control arm 44 to the second linch-pin 50. This raised or neutral position is illustrated in FIG. 7.

The carriage 2 of the present system 1 is equipped with a fluid container 23 for holding cleaning solution and includes a level indicator 24 which allows the operator to monitor the fluid levels during the cleaning operation. When the fluid container 23 reaches refill level, the user raises the top 25 on fluid container 23 by pulling upward on knob 26. If desired, fluid container 23 can be equipped with a hose attachment (not shown) so as to refill the container from a remote location.

Figure 9:
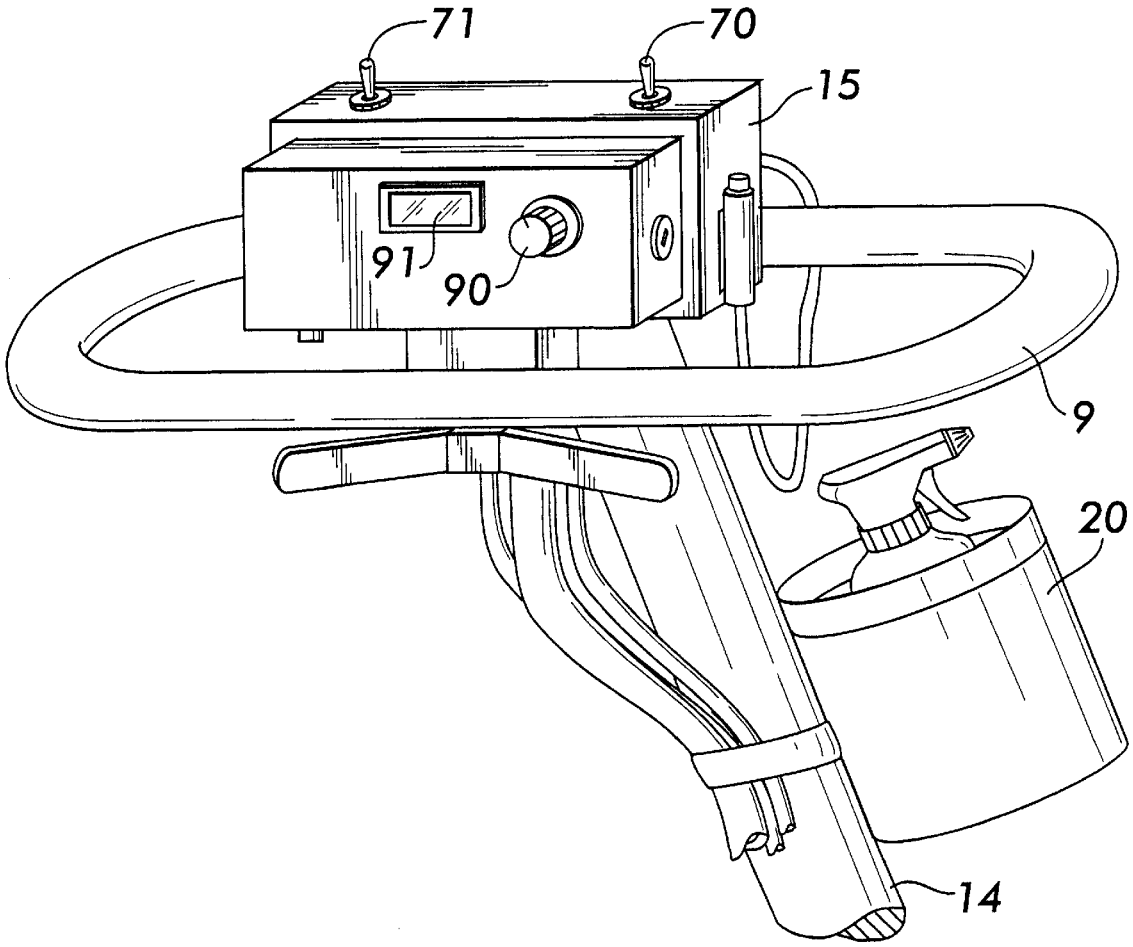
FIG. 9 is a rear perspective view of the control unit by which the cleaning system is operated.

In a typical cleaning, the fluid container 23 is filled with cleaning solution and a three-position switch 61 mounted in the manifold 60 allows the operator to dispense the appropriate fluid onto the surface which is to be cleaned. When the cleaning assembly is in a forward mode, this is accomplished by dispensing the cleaning solution onto the floor surface via the power brush nozzle 67. This power nozzle is held in position by a mounting rod 68 and an adjustable collar 69 which directs the dispensed liquid to an area which is immediately in advance of the brush assembly 30. This dispensing means is automatically activated by a switch 70 which powers the pump 17 that feeds cleaning solution to the manifold 60 via tube 62 (FIGS. 3 and 4). A toggle switch shown as 71 FIG. 9 allows the operator to control the dispensing of the fluid in a forward, backward and neutral mode.

When the cleaning system 1 is in a reverse mode, the operator may avail himself of the hand applicator 63 and dispense the cleaning solution by hand directly onto the area which is to be cleaned. The cleaning solution is fed to the hand applicator 63 via tube 65 and when it is not in use, it is placed into the receiving member identified as 64 in FIG. 1.

One object of this invention is to maximize efficiency by making available to an operator those items which are commonly employed in cleaning operations. This is achieved by providing a utility bin 27 which is releasably secured to the fluid container 23 by a support hook 20 (FIG. 4). Slotted openings 270 in the utility bin 27 provide holding means for various attachments. The utility bin is an optional feature and it may be added or removed from the assembly as desired.

Other features which contribute to operator efficiency, are the receptacle means identified as 19 and 20 in FIG. 1. The receptacle 19 is a pouch for holding items of a personal nature as, for example, food or drink such as a water bottle or the like. In FIG. 1, the receptacle 19 is shown secured to a carriage panel immediately above wheel 5. This is for the benefit for a right-handed user; however, an identical pouch or receptacle can also be secured to an opposite-side panel for the convenience of a left-handed operator. The receptacle may be secured by adhesive or by any means which is known in the art.

The receptacle identified as 20, is a cup-like holder into which a spray bottle may be inserted. This holder may be secured to a steering rod 14 by a clamp or adhesive or any means which is known in the art.

A further embodiment provides for adding to the cleaning system 1 shown in FIG. 1, a second power brush which can be used as an alternative to the power brush identified as 32 (FIGS. 1 and 2) or, alternatively, it may used in tandem in a dual brush arrangement as shown in FIG. 2.

It will be apparent from the forgoing that the cleaning system of this invention provides several improvements over known floor cleaning apparatuses. Principal among these is the powered assembly which allows the bonnet cleaner to provide a straight-line means for cleaning against sidewalls and baseboards. Moreover, the present invention provides for spray means which allow the operator to spray directly onto the area which is to be treated and thus avoid splashing onto walls or baseboards.

Still another improvement of the present invention, is its linking pin assembly which allows for the quick and convenient assembly and disassembly of the motorized carriage from its cleaner assembly.

A still further embodiment of this invention, which is not shown, is to replace the utility bin identified as 27 in FIG. 1 with a wet-vac system which is equipped with a vacuum motor duct and intake nozzle. This enhancement would give the operator the ability to achieve clean up in a one-step operation by providing squeegee and vacuum means.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed is:

1. An operator driven rideable carpet cleaning machine comprising:

a) a carriage including means for supporting the user thereon during use of the machine;

b) front and rear wheels for said carriage;

c) a first power source for driving one of said wheels;

d) a steering control assembly;

e) a bonnet cleaner assembly pivotally mounted to said carriage in advance of said front wheel, said bonnet cleaner assembly comprising a bonnet housing in which a disk-shaped cleaning means is mounted for rotation and driven by a second power source independent of the first power source; and f) tilt assembly means to raise and lower said bonnet cleaner assembly.

2. A rideable cleaning machine as defined in claim 1 in which said disk-shaped cleaning means is a power brush.

3. A rideable cleaning machine as defined in claim 1 in which said carriage includes a tank;

said tank has a pump connected thereto;

a nozzle is provided adjacent to said bonnet cleaner asssembly, and connected to said pump for supplying liquid for cleaning.

4. A rideable cleaning machine comprising:

a) a rider carriage having a powered rear wheel and a forward steering wheel and means for supporting the user thereon during use of the machine;

b) a bonnet cleaner assembly pivotally mounted to said carriage at least partially forward of the forward steering wheel, said bonnet cleaner assembly comprising a bonnet housing in which a disk-shaped cleaning means is mounted for rotation and driven by a power source;

c) said bonnet cleaner assembly having a tilt assembly with a handle to raise it and a latch to lower it; and d) said tilt assembly having a quick disconnect latch from said rider carriage.

5. The rideable cleaning machine claim 4, wherein the quick disconnect latch further comprises a linch-pin support for the tilt assembly.

6. The rideable cleaning machine of claim 5, wherein the rider carriage further comprises a tank and a discharge nozzle.

7. An operator driven rideable carpet cleaning appliance comprising:

a) a carriage;

b) front and rear wheels for said carriage;

c) a motive power source for driving one of said wheels;

d) a steering control assembly;

e) an independently powered bonnet cleaner assembly mounted on said carriage in advance of said front wheel; and f) tilt assembly means to raise and lower said bonnet cleaner assembly, said tilt assembly means comprises a fulcrum on the bonnet cleaner assembly pivotally connected to the carriage, said tilt assembly means having a tiltable handle with said tilt assembly means further comprising a foot operated control arm connected to the handle, said control arm releasably connected to a support anchor to hold the bonnet cleaner assembly off a support surface.

8. The rideable cleaning appliance of claim 7, wherein the tilt assembly means further comprises a quick detach design from the carriage.

9. The rideable cleaning appliance of claim 8, wherein the quick detach design further comprises a strut on the carriage which supports a lynch pin holding the tilt assembly means.

10. The rideable cleaning appliance of claims 8, wherein the quick-detach design further comprises a first lynch pin connection to secure the bonnet cleaner assembly and a second lynch pin to secure the bonnet cleaner assembly in a raised position.

* * * * *